US010341802B2

(12) United States Patent
Krueger et al.

(10) Patent No.: US 10,341,802 B2
(45) Date of Patent: Jul. 2, 2019

(54) METHOD AND APPARATUS FOR GENERATING FROM A MULTI-CHANNEL 2D AUDIO INPUT SIGNAL A 3D SOUND REPRESENTATION SIGNAL

(71) Applicant: DOLBY LABORATORIES LICENSING CORPORATION, San Francisco, CA (US)

(72) Inventors: Alexander Krueger, Hannover (DE); Johannes Boehm, Göttingen (DE); Sven Kordon, Wunstorf (DE); Xiaoming Chen, Hannover (DE); Stefan Abeling, Schwarmstedt (DE); Florian Keiler, Hannover (DE); Holger Kropp, Wedemark (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/768,695

(22) PCT Filed: Nov. 11, 2016

(86) PCT No.: PCT/EP2016/077382
§ 371 (c)(1),
(2) Date: Apr. 16, 2018

(87) PCT Pub. No.: WO2017/081222
PCT Pub. Date: May 18, 2017

(65) Prior Publication Data

US 2019/0069115 A1 Feb. 28, 2019

(30) Foreign Application Priority Data

Nov. 13, 2015 (EP) ..... 15306796

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 2400/01* (2013.01); *H04S 2400/11* (2013.01); *H04S 2420/11* (2013.01)

(58) Field of Classification Search
CPC ..... H04S 7/303; H04S 3/008; H04S 2400/01; H04S 2400/11; H04S 2420/11
See application file for complete search history.

(56) References Cited

U.S. PATENT DOCUMENTS 9,666,195 B2 * 5/2017 Keiler ..... H04S 3/008
9,813,834 B2 * 11/2017 Keiler ..... H04S 3/02
(Continued)

FOREIGN PATENT DOCUMENTS

WO 2012/145176 10/2012
WO 2013/108200 7/2013

OTHER PUBLICATIONS

ISO/IEC JTC 1/SC29 "Information Technology—High Efficiency Coding and Media Delivery in Heterogenous Environments—Part 3: 3D Audio" Jul. 25, 2014.
(Continued)

*Primary Examiner* — David L Ton

(57) ABSTRACT

Currently there is no simple and satisfying way to create 3D audio from existing 2D content. The conversion from 2D to 3D sound should spatially redistribute the sound from existing channels. From a multi-channel 2D audio input signal ($x^{(k)}(t)$) a 3D sound representation is generated which includes an HOA representation Formula (I) and channel object signals Formula (II) scaled from channels of the 2D audio input signal. Additional signals Formula (III) placed in the 3D space are generated by scaling (21, 222; 41, 422; Formula (IV)) channels from the 2D audio input signal and
(Continued)

by decorrelating (24, 25; 44, 45, 451; Formula (V)) a scaled version of a mix of channels from the 2D audio input signal, whereby spatial positions for the additional signals are predetermined. The additional signals Formula (III) are converted (27; 47) to a HOA representation Formula (I).

18 Claims, 5 Drawing Sheets

(56) References Cited

U.S. PATENT DOCUMENTS

2012/0155653 A1* 6/2012 Jax ..... G10L 19/008 381/22
2018/0270600 A1* 9/2018 Boehm ..... H04S 1/007

OTHER PUBLICATIONS

Jerome Daniel, "Representation de Champs Acoustiques, application a la transmission et a la reproduction de scenes Sonores Complexes dans un Context Multimedia" Jul. 31, 2001.
Williams, Earl, "Fourier Acoustics" Chapter 6 Spherical Waves, pp. 183-186, Jun. 1999.
Fliege et al., "A two-stage approach for computing cubature formulae for the sphere", Technical Report, Fachbereich Mathematik, Universitat Dortmund, Nov. 1995, pp. 1-31.
Herre, J. et al "MPEG-H 3D Audio—The New Standard for Coding of Immersive Spatial Audio" IEEE Journal of Selected topics in Signal Processing, vol. 9, No. 5, Aug. 2015, pp. 770-779.
Kendall, Gary S. "The Decorrelation of Audio Signals and Its Impact on Spatial Image" Computer Music Journal, vol. 19, No. 4, Winter, 1995, pp. 71-87.

* cited by examiner

METHOD AND APPARATUS FOR GENERATING FROM A MULTI-CHANNEL 2D AUDIO INPUT SIGNAL A 3D SOUND REPRESENTATION SIGNAL

TECHNICAL FIELD

The invention relates to a method and to an apparatus for generating from a multi-channel 2D audio input signal a 3D sound representation signal which includes a HOA representation signal and channel object signals.

BACKGROUND

Recently a new format for 3D audio has been standardised as MPEG-H 3D Audio [1], but only a small number of 3D audio content in this format is available. To easily generate much of such content it is desired to convert existing 2D content, like 5.1, to 3D content which contains sound also from elevated positions. This way, it is possible to create 3D content without completely remixing the sound from the original sound objects.

SUMMARY OF INVENTION

Currently there is no simple and satisfying way to create 3D audio from existing 2D content. The conversion from 2D to 3D sound should spatially redistribute the sound from existing channels. Furthermore, this conversion (also called upmixing should enable a mixing artist to control this process.

There are a variety of representations of three-dimensional sound including channel-based approaches like 22.2, object based approaches and sound field oriented approaches like Higher Order Ambisonics (HOA). An HOA representation offers the advantage over channel based methods of being independent of a specific loudspeaker set-up and that its data amount is independent of the number of sound sources used. Thus, it is desired to use HOA as a format for transport and storage for this application.

A problem to be solved by the invention is to create with improved quality 3D audio from existing 2D audio content. This problem is solved by the method disclosed in claim 1. An apparatus that utilises this method is disclosed in claim 2.

Advantageous additional embodiments of the invention are disclosed in the respective dependent claims.

The 3D audio format for transport and storage comprises channel objects and an HOA representation. The HOA representation is used for an improved spatial impression with added height information. The channel objects are signals taken from the original 2D channel-based content with fixed spatial positions. These channel objects can be used for emphasising specific directions, e.g. if a mixing artist wants to emphasise the frontal channels. The spatial positions of the channel objects may be given as spherical coordinates or as an index from a list of available loudspeaker positions. The number of channel objects is $C_{ch} \leq C$, where C is the number of channels of the channel-based input signal. If an LFE (low frequency effects) channel exists it can be used as one of the channel objects.

For the HOA part, a representation of order N is used. This order determines the number 0 of HOA coefficients by $0=(N+1)^2$. The HOA order affects the spatial resolution of the HOA representation, which improves with a growing order N. Typical HOA representations using order N=4 consist of O=25 HOA coefficient sequences.

The used signals (channel objects and HOA representation) can be data compressed in the MPEG-H 3D Audio format. The 3D audio scene can be rendered to the desired loudspeaker positions which allows playback on every type of loudspeaker setup.

In principle, the inventive method is adapted for generating from a multi-channel 2D audio input signal a 3D sound representation which includes a HOA representation and channel object signals, wherein said 3D sound representation is suited for a presentation with loudspeakers after rendering said HOA representation and combination with said channel object signals, said method including:

- generating each of said channel object signals by selecting and scaling one channel signal of said multi-channel 2D audio input signal;
- generating additional signals for placing them in the 3D space by scaling the remaining non-selected channels from said multi-channel 2D audio input signal and/or by decorrelating a scaled version of a mix of channels from said multi-channel 2D audio input signal, wherein spatial positions for said additional signals are predetermined;
- converting said additional signals to said HOA representation using the corresponding spatial positions.

In principle the inventive apparatus is adapted for generating from a multi-channel 2D audio input signal a 3D sound representation which includes a HOA representation and channel object signals, wherein said 3D sound representation is suited for a presentation with loudspeakers after rendering said HOA representation and combination with said channel object signals, said apparatus including means adapted to:

- generate each of said channel object signals by selecting and scaling one channel signal of said multi-channel 2D audio input signal;
- generate additional signals for placing them in the 3D space by scaling the remaining non-selected channels from said multi-channel 2D audio input signal and/or by decorrelating a scaled version of a mix of channels from said multi-channel 2D audio input signal, wherein spatial positions for said additional signals are predetermined;
- convert said additional signals to said HOA representation using the corresponding spatial positions.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

A.1 Use of Stems for Different Spatial Distribution

For film productions typically three separate stems are available: dialogue, music and special sound effects. A stem in this context means a channel-based mix in the input format for one of these signal types. The channel-wise weighted sum of all stems builds the final mix for delivery in the original format.

In general, it is assumed that the existing 2D content used as input signal (e.g. 5.1 surround) is available separately for each stem. Each of these stems indexed k=1, . . . , K may have separate metadata for upmixing to 3D audio.

Figure 1:
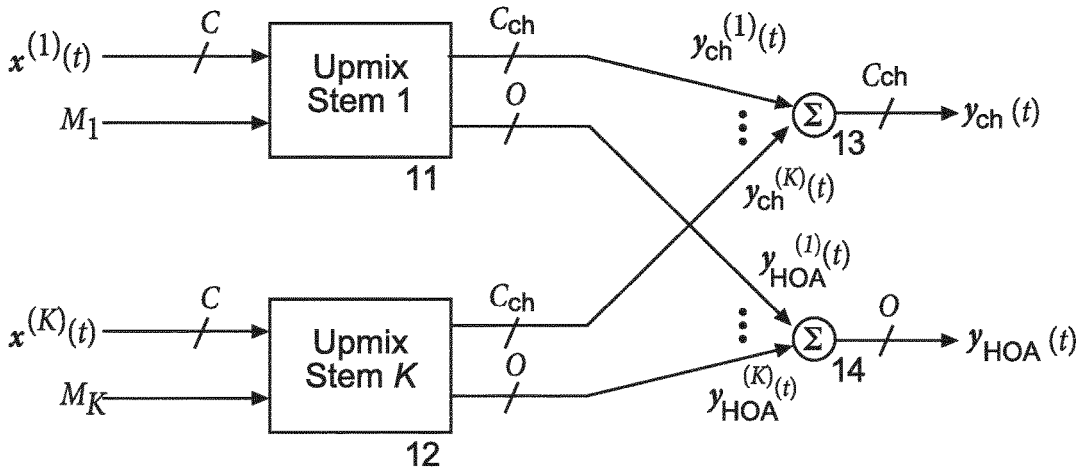
FIG. 1 Upmix of multiple stems and superposition.

FIG. 1 shows a block diagram for upmixing of the separate stems (or complementary components) and for superposition of the upmixed signals. $x^{(k)}(t)$ is a vector with the input channel data at time instant t and C is the number of input channels. Thus, the c-th element of the vector contains one sample of the c-th input channel with c=1, . . . , C.

$M_k$ denotes the metadata used in the upmix process for the k-th stem. These metadata were generated by human interaction in a studio. The output of each upmixing step or stage 11, 12 (for the k-th stem) consists of a signal vector $y_{ch}^{(k)}(t)$ carrying a number $C_{ch}$ of channel objects and a signal vector $y_{HOA}^{(k)}(t)$ carrying a HOA representation with 0 HOA coefficients. The channel objects for all stems and the HOA representations for all stems are combined individually in combiners 13, 14 by $$y_{ch}(t)=\Sigma_{k=1}^{K} y_{ch}^{(k)}(t), \tag{1}$$

$$y_{HOA}(t)=\Sigma_{k=1}^{K} y_{HOA}^{(k)}(t). \tag{2}$$

This kind of processing can also be applied in case no separate stems are available, i.e. K=1. But with the different signal types available in separate stems the spatial distribution of the created 3D sound field can be controlled more flexible. To correctly render the audio scene on the playback side, the fixed positions of channel objects are stored, too.

A.2 Overview of Upmixing for Each Stem

Figure 2:
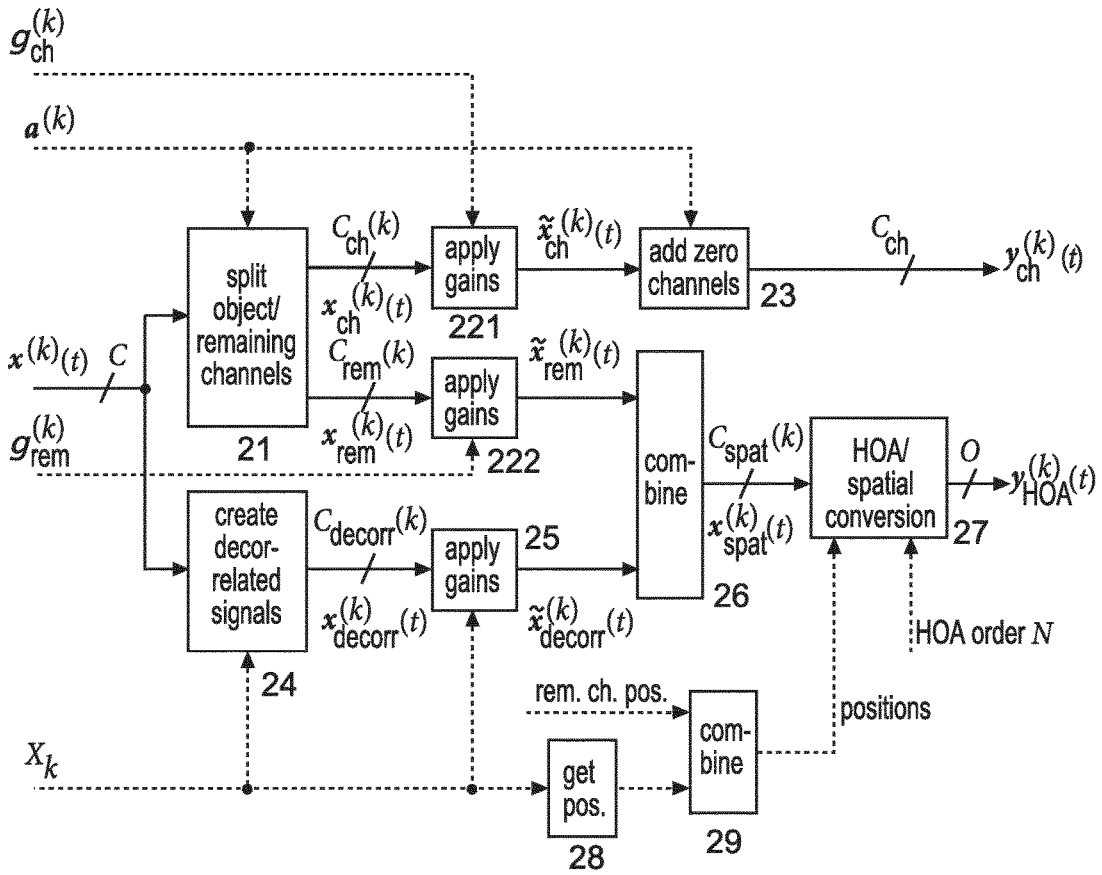
FIG. 2 Block diagram for upmixing of stem k (dashed lines indicate metadata)

The processing of one individual stem k is shown in FIG. 2.

This processing, or a corresponding apparatus, can be used in a studio.

The metadata $M_k$ shown in FIG. 1 are composed of $$M_k=(a^{(k)},X_k,g_{ch}^{(k)},g_{rem}^{(k)}), \tag{3}$$

the elements of which are described below.

$$\text{The set } I=\{1, 2, \ldots, C\} \tag{4}$$

defines the channel indices of all input signals. For the channel objects, a vector a is defined which contains the channel indices of the input signals to be used for the transport signals $y_{ch}^{(k)}(t)$ of the channel objects. The number of elements in a is $C_{ch}$.

Throughout this application small boldface letters are used as symbols for vectors. The same letter in non-boldface type, with a subscript integer index c, indicates the c-th element of that vector.

Thus, the vector a is defined by $a=[a_1, a_2, \ldots, a_{C_{ch}}]^T$ where $(\bullet)^T$ denotes transposition. Each element of this vector must be one of the input channel numbers, i.e. $a_c \in I$ for c=1, . . . , $C_{ch}$. For each individual stem k an index vector $a^{(k)}$ with $C_{ch}(k)$ elements is defined or provided that contains the channel indices of the input signal to be used for the channel objects in this stem. Thus, $C_{ch}(k) \leq C_{ch}$ is the number of channel objects used in stem k. All indices from $a^{(k)}$ must be contained in a. This way it is possible to use a different number of channel objects in the different stems. All channel indices from I that are not contained in $a^{(k)}$ must be contained in the vector $r^{(k)}$ that contains the channel indices for the remaining channels. The number of elements in $r^{(k)}$ is $$C_{rem}(k)=C-C_{ch}(k). \tag{5}$$

In each of the vectors a, $a^{(k)}$, $r^{(k)}$ every channel index can occur only once.

In FIG. 2, splitting step or stage 21 receives the input signal $x^{(k)}(t)$. Using the $a^{(k)}$ data, splitting of the input signal $x^{(k)}(t)$ in two signals with $C_{ch}(k)$ and $C_{rem}(k)$ channels respectively is performed by object splitting. Step/stage 21 can be a demultiplexer. This operation results in a signal vector $x_{ch}^{(k)}(t)$ with the channel objects and a second signal vector $x_{rem}^{(k)}(t)$ which contains those channels from the input signal that are converted to HOA later in the processing chain.

The metadata $g_{ch}^{(k)}$ and $g_{rem}^{(k)}$ define vectors with gain factors for the channel objects and the remaining channels. With these gain values the individual scaled signals are obtained with the gain applying steps or stages 221 and 222 by $$\tilde{x}_{ch,c}^{(k)}(t)=g_{ch,c}^{(k)}\cdot x_{ch,c}^{(k)}(t),\ c=1, \ldots, C_{ch}(k), \tag{6}$$

$$\tilde{x}_{rem,c}^{(k)}(t)=g_{rem,c}^{(k)}\cdot x_{rem,c}^{(k)}(t),\ c=1, \ldots, C_{rem}(k). \tag{7}$$

The zero channels adding step or stage 23 adds to signal vector $\tilde{x}_{ch}^{(k)}(t)$ zero values corresponding to channel indices that are contained in a, but not in $a^{(k)}$. This way, the channel object output $y_{ch}^{(k)}(t)$ is extended to $C_{ch}$ channels. These channel objects are defined by $$y_{ch,c}^{(k)}(t) = \begin{cases} \tilde{x}_{ch,q}^{(k)}, & \text{if } a_c = a_1^{(k)} \text{ with } q \in \{1, \ldots, C_{ch}(k)\} \\ 0, & \text{else} \end{cases} \tag{8}$$

$$\text{for } c = 1, \ldots, C_{th}.$$

It is assumed that a and therefore also $C_{ch}$ are available as global information.

A.2.1 Creation of Additional Sound Signals for Spatial Distribution

The decorrelated signals creating step or stage 24 creates additional signals from the input channels $x^{(k)}(t)$ for further spatial distribution. In general these additional signals are decorrelated signals from the original input channels in order to avoid comb filtering effects or phantom sources when these newly created signals are added to the sound field. For the parameterisation of these additional signals a tuple $$X_k=(T_1^{(k)}, \ldots, T_{c_{decorr}(k)}^{(k)}) \tag{9}$$

from the metadata is used. $X_k$ contains for each additional signal j a tuple $T_j^{(k)}$ of parameters with $$T_j^{(k)}=(\alpha_j^{(k)},f_j^{(k)},\Omega_j^{(k)},g_j^{(k)}),\ j=1, \ldots, C_{decorr}(k), \tag{10}$$

where $C_{decorr}(k)$ is the number of additional (decorrelated) signals in stem k. I.e., $\alpha_j^{(k)}$ and $f_j^{(k)}$ are contained in $X_k$.

Figure 3:
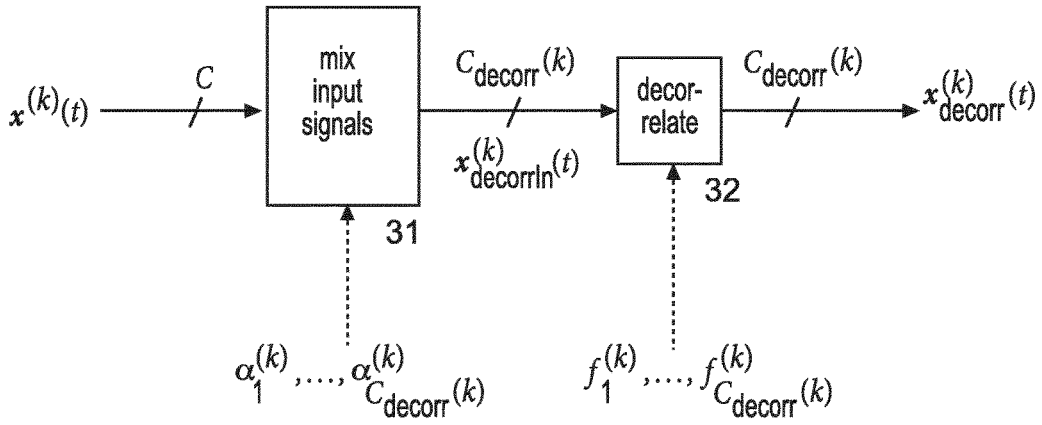
FIG. 3 Block diagram for creation of decorrelated signals of stem k (dashed lines indicate metadata)

The creation of the decorrelated signals in step/stage 24 is shown in more detail in FIG. 3.

In a mixer step or stage 31 the input signals to the decorrelators are computed by mixing the input channels using the vectors $\alpha_j^{(k)}$ containing the mixing weights:

$$x_{decorrInj}^{(k)}(t)=\alpha_j^{(k)T}x^{(k)}(t)=\Sigma_{c=1}^{C}\alpha_{j,c}^{(k)}\cdot x_c^{(k)}(t),\quad j=1, \ldots, C_{decorr}(k). \tag{11}$$

$\alpha_j^{(k)}$ and $f_j^{(k)}$ are contained in $X_k$. This way a (down)mix of the input channels can be used as input to each decorrelator.

In the special case where only one of the input channels is used directly as input to the decorrelator, the vector $\alpha_j^{(k)}$ with the mix gains contains at one position the value 'one' and 'zero' elsewhere. For $j_1 \neq j_2$ it is possible that $\alpha_{j_1}^{(k)} = \alpha_{j_2}^{(k)}$ and $x_{decorrIn,j_1}^{(k)}(t) = x_{decorrIn,j_2}^{(k)}(t)$.

In step or stage 32 the decorrelated signals are computed. A typical approach for the decorrelation of audio signals is described in [4], where for example a filter is applied to the input signal in order to change its phase while the sound impression is preserved by preserving the magnitude spectrum of the signal. Other approaches for the computation of decorrelated signals can be used instead. For example, arbitrary impulse responses can be used that add reverberation to the signal and can change the magnitude spectrum of the signal. The configuration of each decorrelator is defined by $f_j^{(k)}$, which is an integer number specifying e.g. the set of filter coefficients to be used. If the decorrelator uses long finite impulse response filters, the filtering operation can be efficiently realised using fast convolution. In case multiple decorrelated signals are generated from multiple identical input signals and the decorrelation is based on frequency domain processing (e.g. fast convolution using the FFT or a filter bank approach) this can be implemented most efficiently by performing only once the frequency analysis of the common input signal and applying the frequency domain processing and synthesis for each output channel separately.

The j-th element of the output vector $x_{decorr}^{(k)}(t)$ of step/stage 32 is computed by $$x_{decorr,j}^{(k)}(t) = \mathrm{decorr}_{f_j^{(k)}}(x_{decorrIn,j}^{(k)}(t)),\ j=1, \ldots, C_{decorr}(k), \tag{12}$$

where the function $\mathrm{decorr}_{f_j^{(k)}}(\ )$ applies the decorrelator with the parameter $f_j^{(k)}$ to the given input signal.

The resulting signal $x_{decorr,j}^{(k)}(t)$ is the output of step/stage 24 in FIG. 2. In gain applying step or stage 25, all created additional (decorrelated) signals $x_{decorr,j}^{(k)}(t)$ are scaled by individual gain factors according to $$\tilde{x}_{decorr,j}^{(k)}(t) = g_j^{(k)} \cdot x_{decorr,j}^{(k)}(t),\ j=1, \ldots, C_{decorr}(k), \tag{13}$$

which are the elements of signal vector $\tilde{x}_{decorr}^{(k)}(t)$.

A.2.2 Conversion of Spatially Distributed Signals to HOA

The signals from the signal vectors $\tilde{x}_{rem}^{(k)}(t)$ and $\tilde{x}_{decorr}^{(k)}(t)$ are converted to HOA as general plane waves with individual directions of incidence. First, in a combining step or stage 26, these signals are grouped into the signal vector $x_{spat}^{(k)}(t)$ by $$x_{spat}^{(k)}(t) = \begin{pmatrix} \tilde{x}_{rem}^{(k)}(t) \\ \tilde{x}_{decorr}^{(k)}(t) \end{pmatrix}. \tag{14}$$

I.e., basically the elements of the two vectors $\tilde{x}_{rem}^{(k)}(t)$ and $\tilde{x}_{decorr}^{(k)}(t)$ are concatenated. The number of elements in vector $x_{spat}^{(k)}(t)$ is $C_{spat}(k) = C_{rem}(k) + C_{decorr}(k)$.

In HOA and spatial conversion step or stage 27 for each element of $x_{spat}^{(k)}(t)$ a spatial direction is defined that is used for its conversion to HOA. Step/stage 27 also receives parameter N and positions (i.e. spatial positions for HOA conversion for remaining channels and decorrelated signals) from a second combining step or stage 29. Step or stage 28 extracts $\Omega_j^{(k)}$ with $j=1, \ldots, C_{decorr}(k)$ from $X_k$. Step or stage 29 combines the positions $\Omega_{rem,c}^{(k)}$, $c=1, \ldots, C_{rem}(k)$ of remaining channels and the positions $\Omega_{rem,c}^{(k)}$, $c=1, \ldots, C_{decorr}(k)$ of decorrelated signals (taken from $X_k$ using step/stage 28).

In step/stage 27, the first $C_{rem}(k)$ elements (elements taken from $\tilde{x}_{rem}^{(k)}(t)$) are spatially positioned at the original channel directions as defined for the corresponding channels from input signal $x^{(k)}(t)$. These directions are defined as $\Omega_{rem,c}^{(k)}$ with $c=1, \ldots, C_{rem}(k)$, where each direction vector contains the corresponding inclination and azimuth angles, see equation (27). The directions of the signals from vector $\tilde{x}_{decorr}^{(k)}(t)$ are defined as $\Omega_j^{(k)}$ with $j=1, \ldots, C_{decorr}(k)$, see equation (10). The choice of these directions influences the spatial distribution of the resulting 3D sound field. It is also possible to use time-varying spatial directions which are adapted to the audio content.

A mode vector dependent on direction $\Omega$ for HOA order N is defined by $$s(\Omega) := [S_0^0(\Omega)\ S_1^{-1}(\Omega)\ S_1^0(\Omega)\ S_1^1(\Omega) \ldots S_N^{N-1}(\Omega)\ S_N^N(\Omega)]^T, \tag{15}$$

where the spherical harmonics as defined in equation (33) are used. The mode matrix for the different directions of the signals from $x_{spat}^{(k)}(t)$ is then defined by $$\Psi := \kappa \cdot [s(\Omega_{rem,1}^{(k)})\ s(\Omega_{rem,C_{rem}(k)}^{(k)})\ s(\Omega_1^{(k)}) \ldots s(\Omega_{C_{decorr}(k)}^{(k)})] \in \mathbb{R}^{0 \times C_{spat}(k)}, \tag{16}$$

$\kappa > 0$ being an arbitrary positive real-valued scaling factor. This factor is chosen such that, after rendering, the loudness of the signals converted to HOA matches the loudness of objects.

The HOA representation signal is then computed in step/stage 27 by $$c^{(k)}(t) = \Psi^{(k)} \cdot x_{spat}^{(k)}(t) \in \mathbb{R}^{0 \times 1}. \tag{17}$$

This HOA representation can directly be taken as the HOA transport signal, or a subsequent conversion to a so-called equivalent spatial domain representation can be applied. The latter representation is obtained by rendering the original HOA representation $c^{(k)}(t)$ (see section C for definition, in particular equation (31)) consisting of 0 HOA coefficient sequences to the same number 0 of virtual loudspeaker signals $w_j^{(k)}(t)$, $1 \leq j \leq 0$, representing general plane wave signals. The order-dependent directions of incidence $\hat{\Omega}_j^{(N)}$, $1 \leq j \leq 0$, may be represented as positions on the unit sphere (see also section C for the definition of the spherical coordinate system), on which they should be distributed as uniformly as possible (see e.g. [3] on the computation of specific directions). The advantage of this format is that the resulting signals have a value range of [−1,1] suited for a fixed-point representation. Thereby a control of the playback level is facilitated.

Regarding the rendering process in detail, first all virtual loudspeaker signals are summarised in a vector as $$w^{(k)}(t) := [w_1^{(k)}(t) \ldots w_0^{(k)}(t)]^T. \tag{18}$$

Denoting the scaled mode matrix with respect to the virtual directions $\hat{\Omega}_j^{(N)}$, $1 \leq j \leq 0$, by $\hat{\Psi}$, which is defined by $$\hat{\Psi} := \kappa \cdot [s(\hat{\Omega}_1^{(N)})\ s(\hat{\Omega}_2^{(N)}) \ldots s(\hat{\Omega}_0^{(N)})] \in \mathbb{R}^{0 \times 0}, \tag{19}$$

the rendering process can be formulated as a matrix multiplication $$w^{(k)}(t) = \hat{\Psi}^{-1} \cdot c^{(k)}(t) \tag{20}$$

$$= \hat{\Psi}^{-1} \cdot \Psi^{(k)} \cdot x_{spat}^{(k)}(t). \tag{21}$$

Thus, dependent on the use of the conversion to the spatial domain representation, the output HOA transport signal is $$y_{HOA}^{(k)}(t) = \begin{cases} w^{(k)}(t) & \text{if spatial domian representation used} \\ c^{(k)}(t) & \text{else} \end{cases} . \quad (22)$$

A.2.3 Use of Gains for Original Channels and Additional Sound Signals

With the gain factors applied to the channel objects and signals converted to HOA as defined in equations (6), (7), (13), the spatial distribution of the resulting 3D sound field is controlled. In general, it is also possible to use time-varying gains in order to use a signal-adaptive spatial distribution. The loudness of the created mix should be the same as for the original channel-based input. For adjusting the gain values to get the desired effect, in general a rendering of the transport signals (channel objects and HOA representation) to specific loudspeaker positions is required. These loudspeaker signals are typically used for a loudness analysis. The loudness matching to the original 2D audio signal could also be performed by the audio mixing artist when listening to the signals and adjusting the gain values.

In a subsequent processing in a studio, or at a receiver side, signal $y_{HOA}^{(k)}(t)$ is rendered to loudspeakers, and signal $y_{ch}^{(k)}(t)$ is added to the corresponding signals for these loudspeakers.

Figure 4:
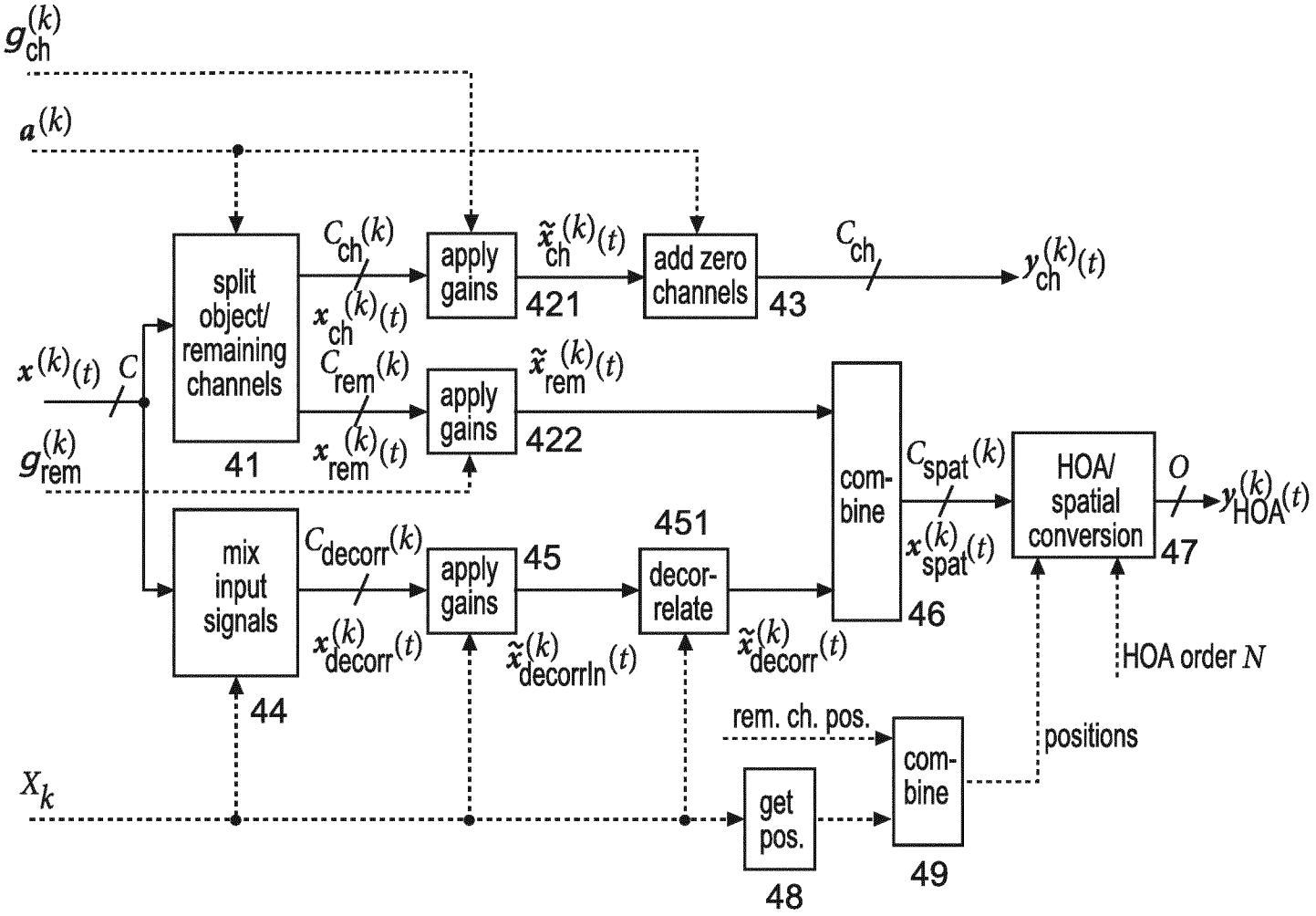
FIG. 4 Block diagram for upmixing of stem k with moved gains (dashed lines indicate metadata)

FIG. 4 shows an alternative to the block diagram of FIG. 2. The gain applying step or stage 45 in the lower signal path is moved towards the input. The gains are applied before the decorrelator step or stage 451 is used (all other steps or stages 41 to 43 and 46 to 49 correspond to the respective steps or stages 21 to 23 and 26 to 29 in FIG. 2). This way, application of the gains inside a digital audio workstation (DAW) is possible in case the decorrelation and HOA conversion is not running inside the same DAW application.

First, the input signals are mixed according to equation (11) in order to obtain $C_{decorr}(k)$ channels contained in the signal vector $x_{decorrIn}^{(k)}(t)$. Second, the desired gain factors are applied to these signals according to $$\tilde{x}_{decorrIn,j}^{(k)}(t)=g_j^{(k)}x_{decorrIn,j}^{(k)}(t),\ j=1,\ldots,C_{decorr}(k). \quad (23)$$

Third, the resulting signals in $\tilde{x}_{decorrIn,j}^{(k)}(t)$ are fed into decorrelators 451 using the corresponding parameters (see also equation (12)):

$$x_{decorr,j}^{(k)}(t)=\mathrm{decorr}_{f_j^{(k)}}(\tilde{x}_{decorrIn,j}^{(k)}(t)),\ j=1,\ldots,C_{decorr}(k). \quad (24)$$

B Exemplary Configuration

Figure 5:
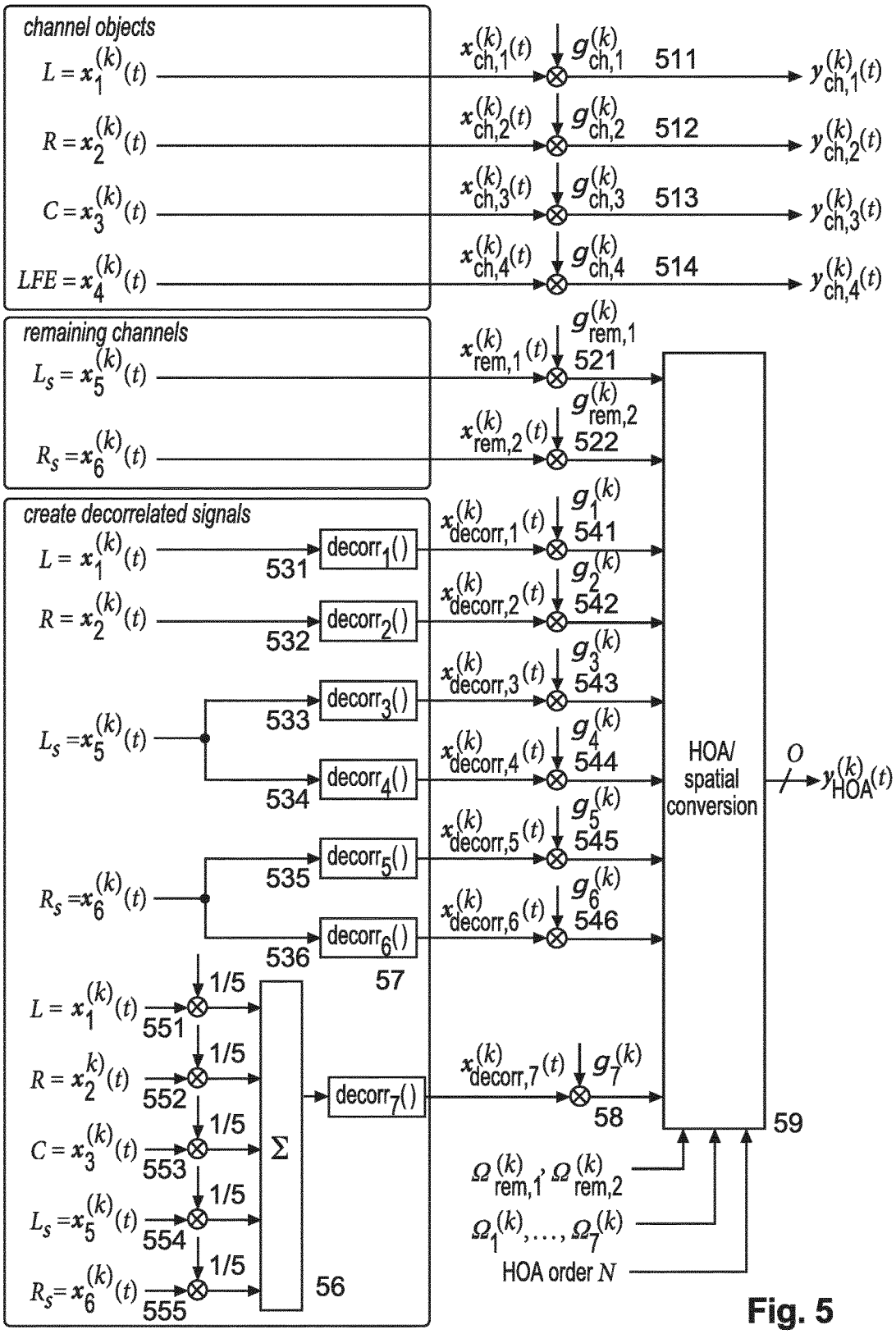
FIG. 5 Upmix example configuration for one stem.

In this section an exemplary configuration for the conversion of a 5.1 surround sound to 3D sound is considered. The signal flow for this example is shown in FIG. 5 for one stem according to FIG. 2. In this example the number of input channels is C=6, the input channel configuration is defined in the following Table 1:

| channel number | channel name | short name |
|---|---|---|
| 1 | front left | L |
| 2 | front right | R |
| 3 | front centre | C |
| 4 | LFE | LFE |
| 5 | left surround | $L_s$ |
| 6 | right surround | $R_s$ |

For the channel objects $C_{ch}$=4 channels are used, which are namely the front left/right/center channels and the LFE channel. Thus, the vector with the input channel indices for the channel objects is $a=[1,2,3,4]^T$. In this example, the same number of channel objects is used for all stems. Thus, $a^{(k)}=a=[1,2,3,4]^T$ and $r^{(k)}=[5,6]^T$ for $1\leq k\leq K$. With K=3 stems this results in $C_{ch}(k)=C_{ch}=4$ for $k\in\{1,2,3\}$. The number of remaining channels is therefore $C_{rem}(k)=C-C_{ch}(k)=2$. In the given example the number of decorrelated signals is $C_{decorr}(k)=7$. For the first six decorrelated signals the decorrelator 531 to 536 is applied with different filter settings to the individual input channels. The seventh decorrelator 57 is applied to a downmix of the input channels (except the LFE channel). This downmix is provided using multipliers or dividers 551 to 555 and a combiner 56. In this example the filter settings are $f_j^{(k)}=j$ for $j=1,\ldots,C_{decorr}(k)$.

The spatial directions used for the conversion to HOA are given in Table 2:

| direction symbol | azimuth φ in deg | inclination θ in deg |
|---|---|---|
| $\Omega_{rem,1}^{(k)}$ | 115 | 90 |
| $\Omega_{rem,2}^{(k)}$ | −115 | 90 |
| $\Omega_1^{(k)}$ | 72 | 60 |
| $\Omega_2^{(k)}$ | −72 | 60 |
| $\Omega_3^{(k)}$ | 90 | 90 |
| $\Omega_4^{(k)}$ | 144 | 60 |
| $\Omega_5^{(k)}$ | −90 | 90 |
| $\Omega_6^{(k)}$ | −144 | 60 |
| $\Omega_7^{(k)}$ | 0 | 0 |

Table 3 shows for upmix to 3D example gain factors for all channels, which gain factors are applied in gain steps or stages 511-514, 521, 522, 541-546 and 58, respectively:

| gain symbol | value in dB |
|---|---|
| $g_{ch,1}^{(k)}$ | −1.5 |
| $g_{ch,2}^{(k)}$ | −1.5 |
| $g_{ch,3}^{(k)}$ | −1.5 |
| $g_{ch,4}^{(k)}$ | 0 |
| $g_{rem,1}^{(k)}$ | −1.5 |
| $g_{rem,2}^{(k)}$ | −1.5 |
| $g_1^{(k)}$ | −7.5 |
| $g_2^{(k)}$ | −7.5 |
| $g_3^{(k)}$ | −1.5 |
| $g_4^{(k)}$ | −1.5 |
| $g_5^{(k)}$ | −1.5 |
| $g_6^{(k)}$ | −1.5 |
| $g_7^{(k)}$ | −1.5 |

In this example the left/right surround channel signals are converted in step or stage 59 to HOA using the typical loudspeaker positions of these channels. From each of the channels L, R, L $R_s$, $R_s$ one decorrelated version is placed at an elevated position with a modified azimuth value compared to the original loudspeaker position in order to create a better envelopment. From each of the left/right surround channels an additional decorrelated signal is placed in the 2D plane at the sides (azimuth angles ±90 degrees). The channel objects (except LFE) and the surround channels converted to HOA are slightly attenuated. The original loudness is maintained by the additional sound objects placed in the 3D space. The decorrelated version of the downmix of all input channels except the LFE is placed for HOA conversion above the sweet spot.

C Basics of Higher Order Ambisonics

Figure 6:
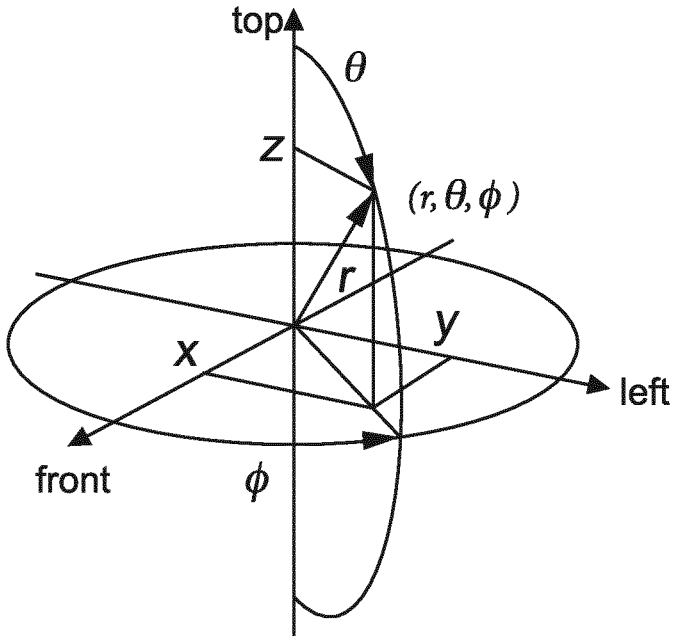
FIG. 6 Spherical coordinate system.

Higher Order Ambisonics (HOA) is based on the description of a sound field within a compact area of interest, which is assumed to be free of sound sources. In that case the spatio-temporal behaviour of the sound pressure p(t,x) at time t and position x within the area of interest is physically fully determined by the homogeneous wave equation. In the following a spherical coordinate system is assumed as shown in FIG. 6. In this coordinate system the x axis points to the frontal position, the y axis points to the left, and the z axis points to the top. A position in space $x=(r,\theta,\phi)^T$ is represented by a radius $r\geq 0$ (i.e. the distance to the coordinate origin), an inclination angle $\theta\in[0,\pi]$ measured from the polar axis z and an azimuth angle $\phi\in[0,2\pi[$ measured counter-clockwise in the x-y plane from the x axis. Further, $(\bullet)^T$ denotes the transposition.

Then it can be shown (cf. [5]) that the Fourier transform of the sound pressure with respect to time denoted by $\mathcal{F}_t(\bullet)$, i.e.

$$P(\omega, x) = \mathcal{F}_t(p(t, x)) = \int_{-\infty}^{\infty} p(t, x)e^{-i\omega t}\, dt, \tag{25}$$

with ω denoting the angular frequency and i indicating the imaginary unit, can be expanded into the series of Spherical Harmonics according to $$P(\omega = kc_s, r, \theta, \phi) = \sum_{n=0}^{N}\sum_{m=-n}^{n} A_n^m(k)\, j_n(kr) S_n^m(\theta, \phi). \tag{26}$$

In equation (26), $c_s$ denotes the speed of sound and k denotes the angular wave number, which is related to the angular frequency ω by $$k = \frac{\omega}{c_s}.$$

Further, $j_n(\bullet)$ denotes the spherical Bessel functions of the first kind and $S_n^m(\theta,\phi)$ denotes the real valued Spherical Harmonics of order n and degree m, which are defined in section C.1. The expansion coefficients $A_n^m(k)$ depend only on the angular wave number k. Note that it has been implicitly assumed that sound pressure is spatially band-limited. Thus the series is truncated with respect to the order index n at an upper limit N, which is called the order of the HOA representation.

Since the area of interest (i.e. the sweet spot) is assumed to be free of sound sources, the sound field can be represented by a superposition of an infinite number of general plane waves arriving from all possible directions $$\Omega=(\theta,\phi), \tag{27}$$

$$p_{(t,x)}=\int_{S^2} p_{GPW}(t,x,\Omega)d\Omega, \tag{28}$$

i.e. where $S^2$ indicates the unit sphere in the three-dimensional space and $p_{GPW}(t,x,\Omega)$ denotes the contribution of the general plane wave from direction Ω to the pressure at time t and position x.

Evaluating the contribution of each general plane wave to the pressure in the coordinate origin $x_{ORIG}=(0\ 0\ 0)^T$ provides a time and direction dependent function $$c(t,\Omega)=p_{GPW}(t,x,\Omega)|_{x=x_{ORIG}}, \tag{29}$$

which is then for each time instant expanded into a series of Spherical Harmonics according to $$c(t, \Omega = (\theta, \phi)) = \sum_{n=0}^{N}\sum_{m=-n}^{n} c_n^m(t) S_n^m(\theta, \phi). \tag{30}$$

The weights $c_n^m(t)$ of the expansion, regarded as functions over time t, are referred to as continuous-time HOA coefficient sequences and can be shown to always be real-valued. Collected in a single vector c(t) according to $$c(t)=[c_0^0(t)\ c_1^{-1}(t)\ c_1^0(t)\ c_1^1(t)\ c_2^{-2}(t)\ c_2^{-1}(t)\ c_2^0(t)\ c_2^1(t)\ c_2^2(t)\ \ldots\ c_N^{N-1}(t)\ c_N^N(t)]^T \tag{31}$$

they constitute the actual HOA sound field representation. The position index of an HOA coefficient sequence $c_n^m(t)$ within the vector c(t) is given by n(n+1)+1+m. The overall number of elements in the vector c(t) is given by $0=(N+1)^2$. It should be noted that the knowledge of the continuous-time HOA coefficient sequences is theoretically sufficient for perfect reconstruction of the sound pressure within the area of interest, because it can be shown that their Fourier transforms with respect to time, i.e. $C_n^m(\omega)=\mathcal{F}_t(c_n^m(t))$, are related to the expansion coefficients $A_n^m(k)$ (from equation (26)) by $$A_n^m(k)=i^n C_n^m(\omega=kc_s). \tag{32}$$

C.1 Definition of Real Valued Spherical Harmonics

The real valued spherical harmonics $S_n^m(\theta,\phi)$ (assuming SN3D normalisation according to chapter 3.1 of [2]) are given by $$S_n^m(\theta, \phi) = \sqrt{(2n+1)\frac{(n-|m|)!}{(n+|m|)!}}\, P_{n|m|}(\cos\theta) trg_m(\phi) \tag{33}$$

with $$trg_m(\phi) = \begin{cases} \sqrt{2}\cos(m\phi) & m > 0 \\ 1 & m = 0 \\ -\sqrt{2}\sin(m\phi) & m < 0 \end{cases}. \tag{34}$$

The associated Legendre functions $P_{n,m}(x)$ are defined as $$P_{n,m}(x) = (1-x^2)^{m/2}\frac{d^m}{dx^m}P_n(x),\ m \geq 0 \tag{35}$$

with the Legendre polynomial $P_n(x)$ and, unlike in [5], without the Condon-Shortley phase term There are also alternative definitions of 'spherical harmonics'. In such case the transformation described is also valid.

For a storage or transmission of the 3D sound representation signal a superposition of channel objects and HOA representations of separate stems can be used.

Multiple decorrelated signals can be generated from multiple identical multi-channel 2D audio input signals $x^{(k)}(t)$ based on frequency domain processing, for example by fast convolution using an FFT or a filter bank. A frequency analysis of the common input signal is carried out only once and that frequency domain processing and is applied for each output channel separately.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

REFERENCES

[1] ISO/IEC JTC1/SC29/WG11 DIS 23008-3. Information technology—High efficiency coding and media delivery in heterogeneous environments—Part 3: 3D audio, July 2014.

[2] J. Daniel, "Représentation de champs acoustiques, application à la transmission et à la reproduction de scènes sonores complexes dans un contexte multimédia", PhD thesis, Université Paris 6, 2001. URL http://gyronymo.free.fr/audio3D/downloads/These-original-version.zip

[3] J. Fliege, U. Maier, "A two-stage approach for computing cubature formulae for the sphere", Technical report, Fachbereich Mathematik, Universität Dortmund, 1999. Node numbers are found at http://www.mathematik.uni-dortmund.de/lsx/research/projects/fliege/nodes/nodes.html.

[4] G. S. Kendall, "The decorrelation of audio signals and its impact on spatial imaginery", Computer Music Journal, vol. 19, no. 4, pp. 71-87, 1995.

[5] E. G. Williams, "Fourier Acoustics", Applied Mathematical Sciences, vol. 93, Academic Press, 1999.

The invention claimed is:

1. A method for generating from a multi-channel 2D audio input signal a 3D sound representation which includes a Higher Order Ambisonics (HOA) representation and channel object signals, wherein said 3D sound representation is suited for a presentation with loudspeakers after rendering said HOA representation and combination with said channel object signals, said method including:

generating each of said channel object signals by selecting and scaling one channel signal of said multi-channel 2D audio input signal;

generating additional signals in a 3D space by scaling non-selected channels from said multi-channel 2D audio input signal or by decorrelating a scaled version of a mix of channels from said multi-channel 2D audio input signal, wherein spatial positions for the additional signals are predetermined;

converting the additional signals to said HOA representation using the spatial positions corresponding to the additional signals.

2. The method according to claim 1, wherein said spatial positions can vary over time and a number corresponding to the spatial positions can vary over time.

3. The method according to claim 1, wherein said scaling is carried out by applying time-varying gain factors.

4. The method according to claim 1, wherein said scaling is adjusted such that said 3D sound representation can be rendered with a loudness of said multi-channel 2D audio input signal.

5. The method according to claim 3, wherein said gain factors are applied before said decorrelating.

6. The method according to claim 1, wherein the multi-channel 2D audio input signal is replaced by multiple multi-channel 2D audio input signals, each representing one complementary component of a mixed multi-channel 2D audio input signal, and wherein each multi-channel 2D audio input signal is converted to an individual 3D sound representation signal using individual conversion parameters, and wherein the 3D sound representations are superposed to a final mixed 3D sound representation.

7. The method according to claim 1, wherein multiple decorrelated signals are generated from one channel signal, or a mix of channel signals, of the multi-channel 2D audio input signal based on frequency domain processing, for example by fast convolution using at least one of an FFT and a filter bank, and wherein a frequency analysis of a common input signal is carried out only once and said frequency domain processing and frequency synthesis is applied for each output channel separately.

8. The method of claim 1, wherein the additional signals are generated by scaling non-selected channels from said multi-channel 2D audio input signal or by de-correlating the scaled version of the mix of channels from said multi-channel 2D audio input signal.

9. An apparatus for generating from a multi-channel 2D audio input signal a 3D sound representation which includes a Higher Order Ambisonics (HOA) representation and channel object signals, wherein said 3D sound representation is suited for a presentation with loudspeakers after rendering said HOA representation and combination with said channel object signals, said apparatus comprising:

a processor configured to generate each of said channel object signals by selecting and scaling one channel signal of said multi-channel 2D audio input signal;

wherein the processor is further configured to generate additional signals for placing them in a 3D space by scaling non-selected channels from said multi-channel 2D audio input signal or by decorrelating a scaled version of a mix of channels from said multi-channel 2D audio input signal, wherein spatial positions for said additional signals are predetermined;

wherein the processor is further configured to convert said additional signals to said HOA representation using corresponding spatial positions.

10. The apparatus of claim 9, the processor is further configured to generate the additional signals by scaling non-selected channels from said multi-channel 2D audio input signal or by de-correlating the scaled version of the mix of channels from said multi-channel 2D audio input signal.

11. The apparatus of claim 9, wherein the processor is further configured to generate additional signals for placing them in the 3D space by scaling remaining non-selected channels from said multi-channel 2D audio input signal or by de-correlating the scaled version of the mix of channels from said multi-channel 2D audio input signal, wherein spatial positions for said additional signals are predetermined.

12. The apparatus according to claim 10, wherein said spatial positions can vary over time and a number corresponding to the spatial positions can vary over time.

13. The apparatus according to claim 10, wherein said scaling is carried out by applying time-varying gain factors.

14. The apparatus according to claim 9, wherein the scaling is adjusted such that said 3D sound representation can be rendered with a loudness of said multi-channel 2D audio input signal.

15. The apparatus according to claim 9, wherein said gain factors are applied before said decorrelating.

16. The apparatus according to claim 9, wherein the multi-channel 2D audio input signal is replaced by multiple multi-channel 2D audio input signals, each representing one complementary component of a mixed multi-channel 2D audio input signal, and wherein each multi-channel 2D audio input signal is converted to an individual 3D sound representation signal using individual conversion parameters, and wherein the 3D sound representations are superposed to a final mixed 3D sound representation.

17. The apparatus according to claim 9, wherein multiple decorrelated signals are generated from one channel signal, or a mix of channel signals, of the multi-channel 2D audio input signal based on frequency domain processing, for example by fast convolution using at least an FFT and a filter bank, and a frequency analysis of a common input signal is carried out only once and said frequency domain processing and frequency synthesis is applied for each output channel separately.

18. A non-transitory computer-readable storage medium storing instructions which, when executed by a processor, perform the method according to claim 1.

* * * * *